United States Patent [19]

Slavsky

[11] 4,159,587

[45] Jul. 3, 1979

[54] WEIGHTED PRICER

[75] Inventor: Robert J. Slavsky, Southfield, Mich.

[73] Assignee: Shaw & Slavsky, Inc., Detroit, Mich.

[21] Appl. No.: 814,443

[22] Filed: Jul. 11, 1977

[51] Int. Cl.[2] ..... G09F 3/14

[52] U.S. Cl. ..... 40/11 A; 40/10 R; 40/606

[58] Field of Search ..... 40/11 A, 11 R, 10 R, 40/10 A, 10 B, 10 C, 10 D, 2 F, 608, 607, 606, 609, 610, 16.2, 16, 16.4; 248/350, 339

[56] References Cited

U.S. PATENT DOCUMENTS

| | | | |
|---|---|---|---|
| 1,384,106 | 7/1921 | Taussig | 40/606 X |
| 2,563,159 | 8/1951 | Clark | 40/10 R |
| 2,923,078 | 2/1960 | Slavsky | 40/16.4 X |
| 3,070,911 | 1/1963 | Slavsky | 40/10 R |
| 3,820,195 | 6/1974 | Hutzell | 248/339 X |

FOREIGN PATENT DOCUMENTS

| | | | |
|---|---|---|---|
| 459589 | 9/1949 | Canada | 40/16.4 |

*Primary Examiner*—John F. Pitrelli
*Attorney, Agent, or Firm*—Cullen, Sloman, Cantor, Grauer, Scott & Rutherford

[57] ABSTRACT

A weighted pricer comprises a wire support whose upper end is secured to a price tag or similar article, with the lower end of the pricer being secured to a flat weight so as to enable the pricer to rest in a weighted manner upon a food item such as a slab of meat, deli, or cheese or the like.

2 Claims, 9 Drawing Figures

WEIGHTED PRICER

BACKGROUND OF THE INVENTION

Pricers are known. One example, as shown in Shaw Pat. No. 2,142,085 has the lower ends of the wire support provided with sharp points to enable the wire to be inserted in a food slab by staking the pricer into the slab, the lower ends being sharply pointed for this purpose. In another pricer, as shown in Slavsky Pat. No. 3,070,911 of Jan. 1, 1963, the wire at the end opposite the end which supports the price tag, is itself of Z or W form as shown in such U.S. Pat. No. 3,070,911, with the bends providing a spring mounting for the pricer in a channeled shelf molding.

SUMMARY OF THE INVENTION

The pricer hereof is intended to rest upon a food item with its own weight holding the pricer in place. The absence of sharp points for staking the pricer into the food item eliminates the penetration of the food item by the sharp pointed ends of the pricer wire and eliminates the danger of injury to the hands and fingers of the persons handling the food. The food item is not penetrated or punctured. Sanitary conditions are preserved. The food item is in no way despoiled by the resting of the pricer upon it, and is no way is less attractive in appearance than originally, when the pricer is removed, for the pricer merely lays upon the food item and is easily lifted off to be moved to another food item or elsewhere. The weighted pricer can be removed very easily and very quickly from the food item displayed, and at no time disfigures the food item, never puncturing it, never creating unsanitary puncture holes, and never spoiling the food item as to appearance or otherwise. The pricer hereof also conforms to the requirements of the industry and health regulations in all respects and particularly in the absence of contact of metal with the food item and particularly as to inexpensiveness of manufacture.

Since food items differ widely in the shape and formation of their upper surfaces upon which the weighted pricer may rest, the lower end of the pricer, the weighted end, is formed soft and pliable so that it can be curved easily by a store person to conform to the curvature of the surface of the food item. This is particularly important where the food item is a slab of meat, or a curved roll of meat such as bologna, or a cheese roll, all of which have curved surfaces upon which pricers may rest. With the pricer hereof, having its weighted end formed soft and pliable, such lower end may be curved easily and manually by the store person to conform to the curvature of the food item and thus improve the stability of the pricer when resting upon the food item.

The pricer hereof may be instantaneously removed from the food item without disfiguring the food item, never puncturing it, never creating unsanitary puncture holes, never permitting metal contact with the food item, and never despoiling the food item as to appearance or quality.

THE DRAWING

A preferred embodiment of the pricer hereof is disclosed in the appended drawing. In the drawing.

DETAILED DESCRIPTION

Figure 1:
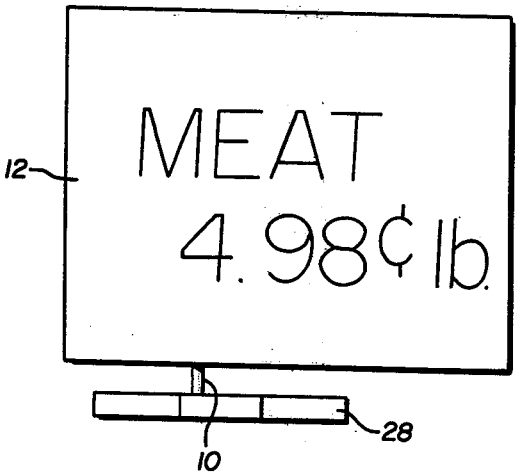
FIG. 1 is a front elevation view of the pricer.
Figure 2:
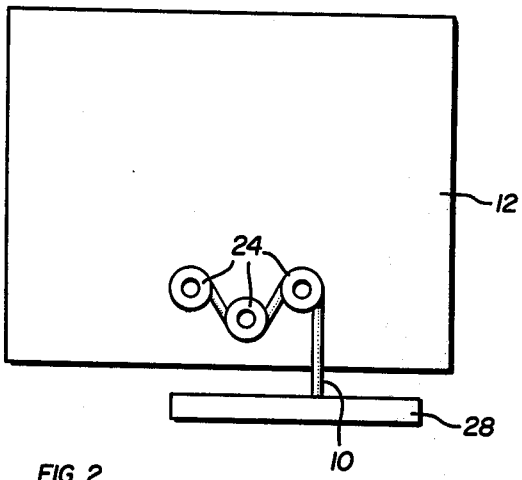
FIG. 2 is a rear elevation view of the pricer.
Figure 3:
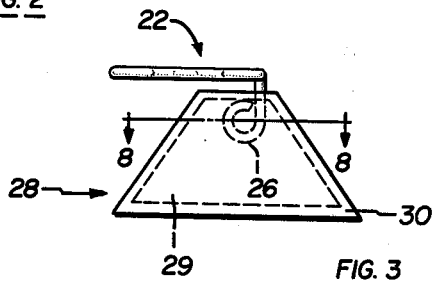
FIG. 3 is a top plan view of FIG. 2 but without the price tag being shown in place.

The weighted pricer hereof comprises a wire support, a piece of wire 10, a price tag or similar article 12 secured to an upper end of the wire to be supported by it and a weight 28 secured to a lower end of the wire for supporting the wire and the price tag 12 upon a food item whose price is to be displayed.

The wire has its upper end curled as at 20 and bent roughly M-shaped as at 22 in the plane of the price tag 12 to provide three locations for rivets 24 for securing the wire 10 to the price tag 12 in the plane of such tag, all in accordance with the aforementioned prior U.S. Pat. No. 2,142,085.

Figure 6:
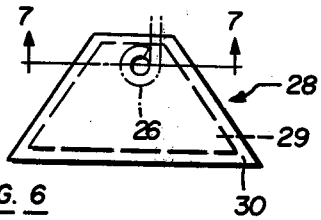
FIG. 6 is a top plan view of the weight for the lower end of the pricer.
Figure 7:
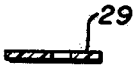
FIG. 7 is a partial section view as if on line 7—7 of FIG. 6.
Figure 8:
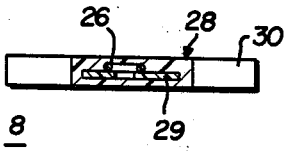
FIG. 8 is a partial section view as if on line 8—8 of FIG. 3.

The wire 10 also has its lower end bent transversely from the remainder of the wire so as to occupy a transverse plane and having its lower end curled as shown at 26 to provide a location for a rivet to secure the lower end to a sheet like weight 28 shown per se in FIGS. 6 and 7. The weight 28 comprises a thin piece of pliable heavy lead-like material 29 riveted at the curl 26 to the lower end of the wire 10. In the presently preferred embodiment the weight 29 is a thin sheet of lead which is heavy and pliable.

The curls at the upper and lower ends of the wire as shown at 20 and 26 are closed sufficiently to prevent the wires from tangling during high speed quantity manufacture of the wires.

The lower end of the wire 10 and the weight 28 are coated with a heavy sanitary plastic coating 30. In the preferred embodiment this coating is of a polyvinyl chloride plastic commonly used in the food industry as for example on the pricing tags 12 themselves. The plastic coating is applied by dipping the partially completed pricer into the then liquid plastic which is then hardened to seal and coat the lead weight base and particularly the lower end of the wire itself. The plastic may then be baked, and preferably is baked until the plastic is no longer liquid but the plastic retains its pliability even when so baked. So baked it is smooth and sanitary without grains or crevices to hold contaminating food particles. The selection of the plastic is of course well within the skill of the trade and nothing critical is attached to the specific plastic selected.

MANUFACTURING PROCESS

Figure 4:
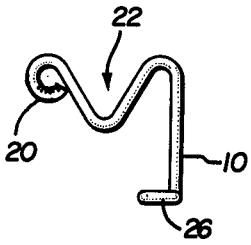
FIG. 4 is a rear elevation view of the wire per se.
Figure 5:
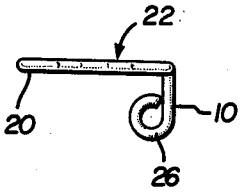
FIG. 5 is a top plan view of the wire per se.

In manufacturing the completed article the steps generally are as follows. First the wire is bent more or less to the form shown in FIGS. 4 and 5. Then the ends of the wire are riveted to the price tag 12 and to the weight 28. After that the weight 28 and the lower end of the wire 10 are dipped into the plastic for coating the lower end of the pricer.

Figure 9:
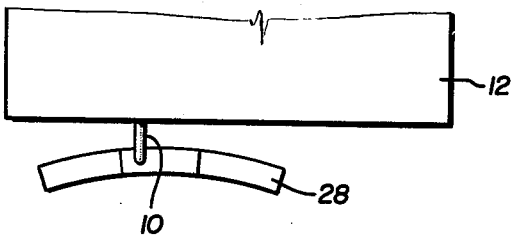
FIG. 9 is a view of the lower end of the pricer in rear elevation but showing the lower weighted end of the pricer curved to conform to a food item curvature.

It is important to note that the plastic coating is and should be of a nature which permits the weighted end of the pricer to be bent easily and manually as desired as shown in FIG. 9.

CONCLUSION

Now having described and herein disclosed a preferred embodiment of the pricer of my invention, reference should be had to the following claims which point out and distinctly claim the pricer which I regard as my invention.

I claim:

1. A weighted pricer comprising a wire support; a price tag or similar article secured to an upper end of the wire support to be supported by it; and a weight secured to a lower end of the support for supporting the pricer and the article upon a food item whose price is to be displayed;

said support comprising a piece of wire whose upper end is curled and is bent roughly M-shaped in one plane to provide three locations for rivets to secure the support to the price tag occupying the same plane;

said wire also having its lower end bent transversely from the remainder of the support, so as to occupy a transverse plane, and having its lower end curled to provide a location for a rivet to secure the lower end to a sheet like weight;

said weight comprising a thin piece of heavy pliably lead-like material riveted to the lower end of the wire;

said weight being sufficiently pliable so as to be easily bent to conform to a contoured surface of the food item;

said weight being sufficiently heavy to maintain the pricer in a stable position on said food item; and the lower end of said support, including said weight, are coated with a heavy, plastic, sanitary coating.

2. A pricer according to claim 1 wherein the curls at the upper and lower ends of the wire are closed sufficiently to prevent tangling of the supports during high speed quantity manufacture of same.

* * * * *